US005415344A

United States Patent [19]

Harrelson

[11] Patent Number: 5,415,344

[45] Date of Patent: May 16, 1995

[54] OPEN-TOP CONTAINER

[75] Inventor: Glen R. Harrelson, Roswell, Ga.

[73] Assignee: Riverwood International Corporation, Atlanta, Ga.

[21] Appl. No.: 310,131

[22] Filed: Sep. 21, 1994

[51] Int. Cl.[6] ..... B65D 5/32; B65D 5/49

[52] U.S. Cl. ..... 229/169; 229/23 R; 229/120.38; 229/182

[58] Field of Search ..... 229/23 R, 109, 165, 229/172, 182, 120.38, 169, 915; 206/565

[56] References Cited

U.S. PATENT DOCUMENTS 2,657,849 11/1953 Paul et al. ..... 229/169
2,998,909 9/1961 Anderson, Jr. et al. ..... 229/120.38
3,940,053 2/1976 Putman et al. ..... 229/915
4,372,476 2/1983 Harned et al. ..... 229/915
4,389,013 6/1983 Hall et al. ..... 229/915
4,482,074 11/1984 Lalley ..... 229/23 R
4,497,408 2/1985 Jes ..... 229/915
4,993,623 2/1991 Kelly et al. ..... 229/23 R
5,002,224 3/1991 Muise ..... 229/169
5,361,974 11/1994 Earl et al. ..... 229/23 R

*Primary Examiner*—Gary E. Elkins

[57] ABSTRACT

A container formed by wrapping a slotted flexible sheet about rigid end panels having upper corner projections that extend through the slots. The sheet is attached to the end panels by locking tabs extending from inwardly sloped portions of the side panels. By using locking tabs instead of upper panel flaps the side panels of the container may be of multi-ply construction when required by anticipated loading and shipping stresses.

20 Claims, 4 Drawing Sheets

OPEN-TOP CONTAINER

FIELD OF THE INVENTION

This invention relates to packaging and shipping containers which need not be fully enclosed but must be sturdy enough to protect the contents, typically produce, during handling and shipment. More particularly, the invention relates to a container of this type which can readily be modified to change the side wall structure according to strength requirements.

BACKGROUND OF THE INVENTION

Articles such as produce ideally should be packaged in containers which protect the contents against bruising or other damage during shipment and handling. They should also present an appealing appearance so that they can be used as retail packages after reaching their final destination, and should be economical as well.

One type of container used for this purpose is comprised of rigid end panels about which a flexible cover sheet is wrapped in order to form the bottom, side and top panels. The end panels include stacking projections on their upper or lower edges and stacking recesses on their opposite edge. When the containers are stacked, the projections from one container fit into the recesses of the next higher or lower container. The flexible sheet includes slots for receiving the stacking projections and the corners of the end panels. Means are also provided on the end panels for holding the ends of the sheet in place. Typically, the ends of the sheet may overlap to form a fully enclosed container or they may be spaced from each other to provide a partially open top panel. Depending on the weight of the contents of the containers, the number of containers stacked on a pallet and the force applied when strapping or stretch wrapping the containers onto a pallet, the strength requirements of the side panels of the containers will vary. For certain applications the side walls formed from cover sheets of conventional thickness sometimes become bowed or crushed. The normal response to correct this situation is to increase the caliper of the cover sheets. This also increases the caliper of the bottom panel, even though the strength of the bottom panel may already be adequate. It may also require different container designs in order to meet different strength objectives, which in turn requires an expensive inventory of different cutting dies for producing the various cover sheets used to form the bottom and side panels.

A main object of this invention is to provide a container which makes use of the basic design concept described above, but which can be modified according to the strength requirements for any individual order of containers. Another object is to provide means for maintaining the ends of the cover sheet in place which does not interfere with the ability to modify the container to meet special strength requirements.

BRIEF SUMMARY OF THE INVENTION

The improved container of the invention is based on the type of container discussed above, which comprises bottom and side panels formed from a flexible sheet extending between spaced relatively rigid end panels. The ends of the sheet are held in place by locking tabs which extend from upper sloped portions of the side panels and which are secured to projections on the end panels. Although the specific design of the locking tabs may vary, they function so as to substantially eliminate a top panel for the container, making it possible for the side panels to be of single- or multi-ply construction. This enables the same basic design of container to be reinforced with additional plies of material if anticipated loading or shipping stresses for a particular use of the containers require containers of greater strength.

These and other features and aspects of the invention, as well as its various benefits, are made more clear in the detailed description of the preferred embodiments which follows.

DETAILED DESCRIPTION OF THE PREFERRED EMBODIMENTS

Figure 1:
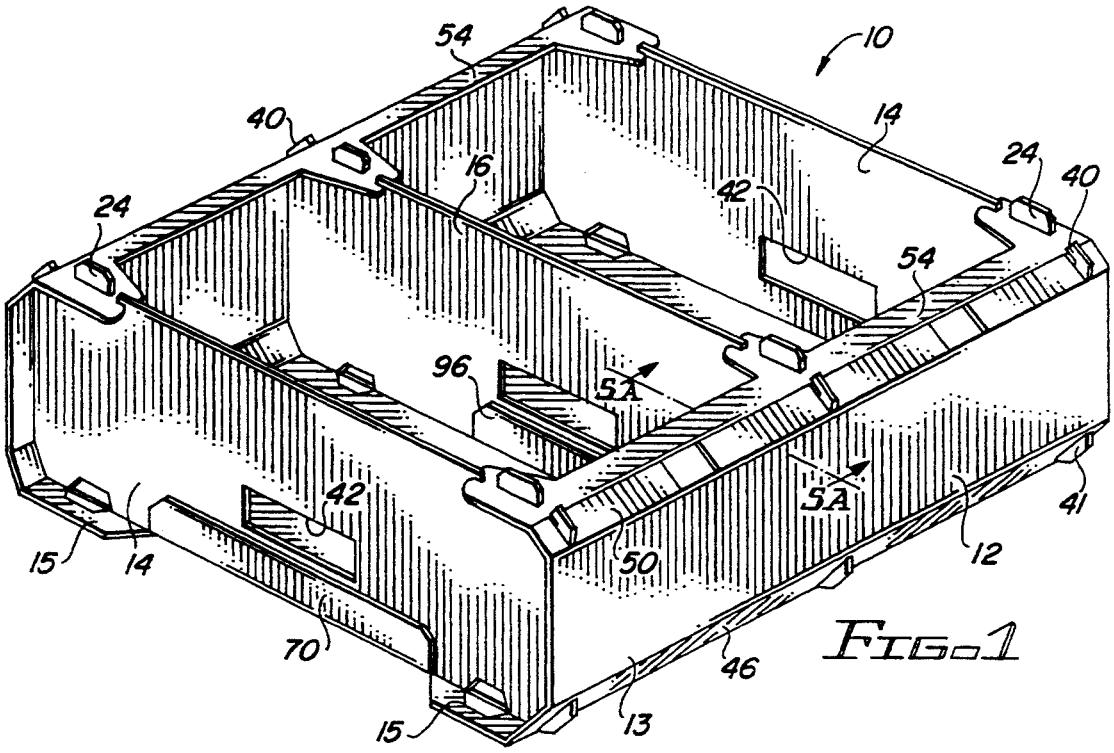
FIG. 1 is a pictorial view of one embodiment of the container of the invention.

Referring to FIG. 1, a container 10 of the type embodying the concepts of the invention is comprised of a flexible cover sheet 12 and rigid end panels 14. The cover sheet forms the side panels 13 and the bottom panel 15. An intermediate cross panel 16 similar to the end panels 14 divides the container into two bins. It should be understood that the invention is not limited to a two-bin construction, but may be incorporated in containers which have no cross panels or which may have more than one cross panel. The flexible cover sheet may be formed of paperboard of a thickness normally used in the manufacture of carriers from foldable paperboard blanks, while the end panels may be formed of thick paperboard, pressed board or any other readily available economical rigid material.

Figure 2:
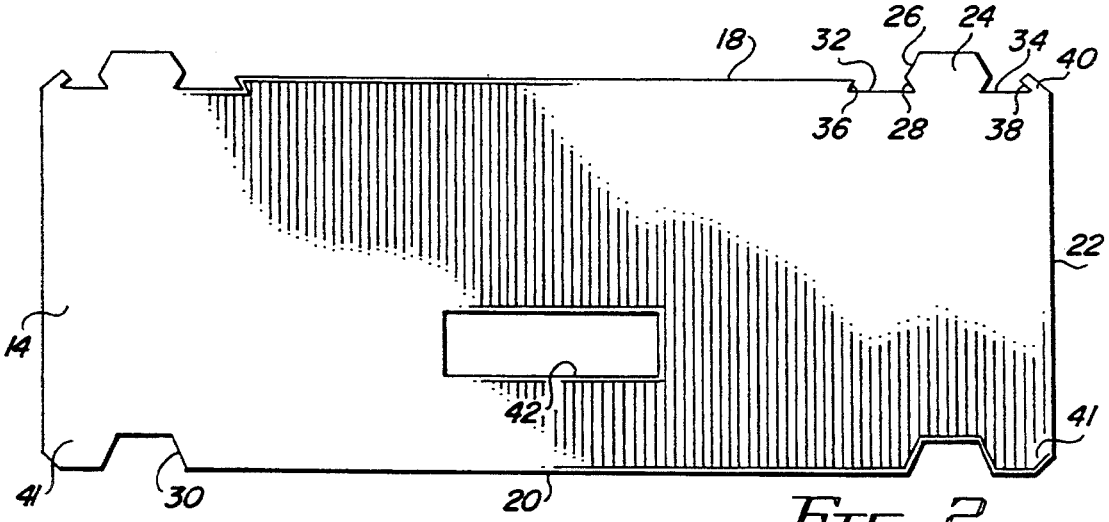
FIG. 2 is a plan view of an end panel incorporated in the container of FIG. 1.

The end panel 14 shown in FIG. 2 is of generally rectangular shape, having upper and lower edges 18 and 20, respectively, and side edges 22. Projecting upwardly from the end panel are two spaced stacking projections 24 having side edge portions 26 which taper outwardly to approximately the plane of the upper panel edge 18 and side edge portions 28 which taper inwardly for a short distance from the lower end of the side edge portions 26. Two similarly shaped stacking recesses 30 are formed in the lower edge 18 so as to be aligned with the projections 24. Adjacent each side of the projections 24 are recesses 32 and 34. Each of the recesses 32 and 34 has a side edge comprised of the tapered projection edge portion 28. The opposite edge 36 of the recess 32 and the opposite edge 38 of the recess 34 are both tapered outwardly so as to be tapered opposite to the adjacent tapered edge 28. Each upper corner area of the end panel includes an upwardly projecting shoulder 40, the inner edge of which is the recess edge 38. The lower portions of the end panel between the side edges 22 and the stacking recesses 30 constitutes a support foot 41. An opening 42 provides a hand grip for lifting the container and also allows air to flow into the container to keep packaged produce in fresh condition.

Referring back to FIG. 1, the stacking projections 24 extend up through slots in the cover sheet to hold the ends of the cover sheet in place, as described in more detail below, while the shoulder projections 40 and the support feet 41 extend through slots in upper and lower bevel panels 50 and 46.

Figures 3, 4, 5:
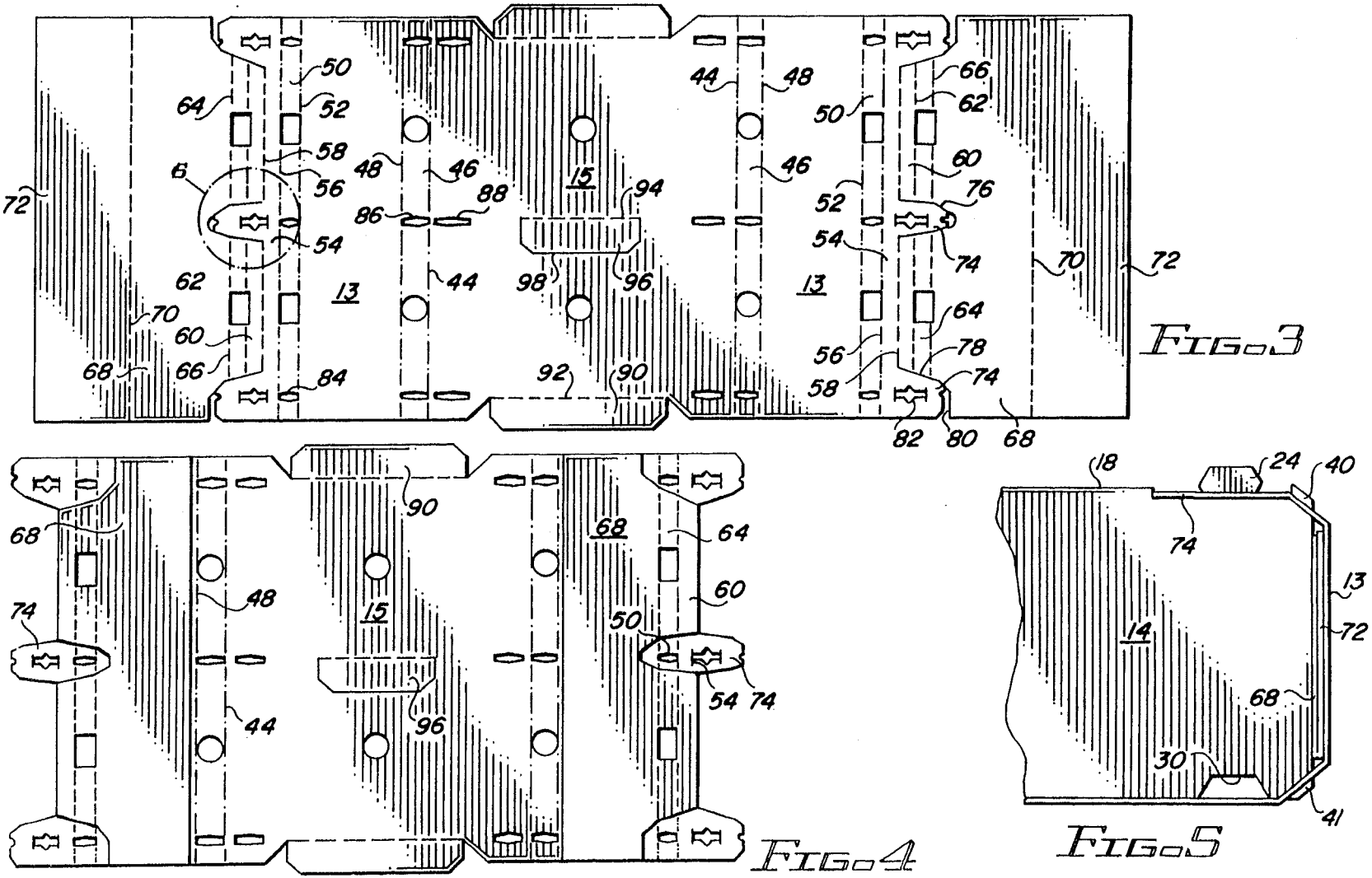
FIG. 3 is a plan view of the blank used in forming the cover sheet employed in the container of FIG. 1.
FIG. 4 is a plan view of the blank of FIG. 3 after initial folding steps have been completed.
FIG. 5 is an enlarged partial end view of the container of FIG. 1.

The blank used to form the cover sheet of the container of FIG. 1 is shown in FIG. 3, wherein similar reference numerals to those used in FIG. 1 denote similar elements. The substantially rectangular blank includes a series of parallel fold lines which allow the sheet to be folded about spaced end panels and an intermediate cross panel to form the bottom and side panels of the container. Thus, the centrally located bottom panel section 15 is connected by fold lines 44 to lower bevel panel sections 46, which in turn are connected by fold lines 48 to side panel sections 13. Upper bevel panel sections 50 are connected to the side panel sections 13 by fold lines 52 and to narrow top panel strips 54 by fold lines 56. The top panel strips 54 are connected by fold lines 58 to top strip reinforcing sections 60 which are connected by fold lines 62 to bevel panel reinforcing sections 64. Fold lines 66 connect the bevel panel reinforcing sections 64 to first reinforcing side panel sections 68, and fold lines 70 connect the latter sections to second reinforcing side panel sections 72. Extending from the end and central portions of the top panel strips 54 are locking tabs 74 which interrupt and extend across the fold lines 62 and 66. The central locking tabs are defined by slits 76 extending from fold lines 58, while the end locking tabs are defined by slits 78 extending from the fold lines 58, by cutouts 80 adjacent the edges of the blank and by the edges of the blank itself.

The locking tabs include slots.82 for receiving the projections 24 of the end and intermediate cross panels, and the upper bevel panel sections 50 include slots 84 for receiving the corner shoulders 40. Slots 86 are also provided in the lower bevel panel sections 46 for receiving the support feet 41 and, in addition, slots 88 are provided in the lower panel section to allow passage of the stacking projections of the next lower container in a stacked arrangement. End glue flaps 90 are connected to the bottom panel section by fold lines 92. Also connected to the bottom panel by fold line 94 is intermediate glue flap 96, which is defined by the slit 98.

To fabricate the container of FIG. 1, glue is applied to either the first or second reinforcing side panel sections 68 or 72 and to the side panel sections 13. The second reinforcing side panel section 72 is then pivoted about fold line 70 and adhered to the first reinforcing side panel section 68, after which the combined reinforcing panel sections are pivoted about fold line 58 and adhered to the side panel sections 13. The blank at this point appears as in FIG. 4.

Two end panels 14 are then centered and glued to the end glue flaps 90 and a similar intermediate cross panel is centered and glued to the intermediate glue flap 96. After folding the glue flaps up so that the panels 14 and 16 are upright, the lower bevel panel sections and the side panel sections of the blank of FIG. 4 are folded up so that the corner portions of support feet 41 extend through the slots 86 in the lower bevel panel sections 46. The upper bevel sections are then folded so that the shoulders 40 of the panels 14 extend through the slots 84 in the upper bevel panel sections 50 and the stacking projections 24 extend through the slots 82 in the locking tabs 74 to form the container of FIG. 1.

Figure 5A:
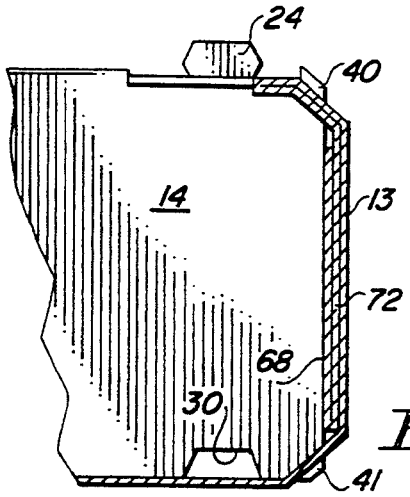
FIG. 5A is a transverse sectional view taken along line 5A—5A of FIG. 1.

Referring to FIG. 5, it can be seen that the first and second reinforcing side panel sections 68 and 72 and the side panels 13 provide a three-ply wall which possesses adequate strength to resist the most extreme probable forces to which it will be subjected during packaging and shipping. It will be understood that the containers are adapted to be stacked, with the stacking projection 24 fitting into the recess 30 of the next higher container in the stack. Although the end view of FIG. 5 does not illustrate the folded connection between the outer ply 13 and the second reinforcing side panel section 72, FIG. 5A shows that the outer ply 13 is connected by fold line to the intermediate ply 72, and that the latter ply is connected by fold line to the interior ply 68 as a result of the folding process described above.

Figure 6:
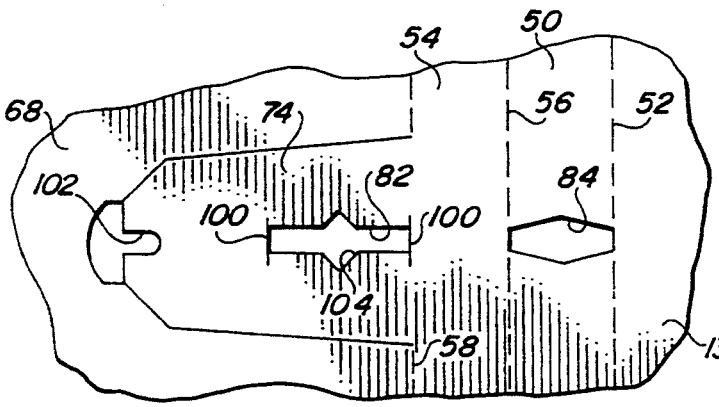
FIG. 6 is an enlarged plan view of the area of FIG. 3 within the circle 6, showing the fastening tab therein.

As shown in FIG. 6, slits 100 extend for a short distance into the locking tab 74 from the end edges of the slot 82 and the free end of the tab is notched as at 102. The dimensions of the slot 82 are related to the stacking projection 24 of the end and intermediate panels 14 such that the length of the slot is substantially equal to the width of the projection 24 at its lowermost point. The projection is substantially wider, as measured between the points of intersection of the tapered edges 26 and 28, and is substantially narrower, as measured at its end. When securing a locking tab in place, the ends of the slot encounter the projection on the tapered edge surfaces 26 prior to reaching the widest dimension of the projection. As the locking tab is continued to be pushed down, the tapered edges act as cams to push the body of the locking tab back immediately adjacent the slot. The slits 100 enable the tab body to act in this manner as a kind of biased flap, permitting the slot to move past the greatest width of the projection and down to the base of the projection. The slot is also notched at opposite sides at 104, which facilitates relative movement of the slot edges over the projection by decreasing the drag or friction between these surfaces. Because the ends of the slot are now below the widest point on to the projection, the locking tab is effectively held in place against upward movement.

The portion of the locking tab between the slot 82 and the end of the tab can be flexed down to move the notch 102 up against the base of the tapered edge 28. When the force moving the locking tab into position is removed, the edge 28 prevents upward movement of the locking tab end, providing a secondary lock.

Figure 7:
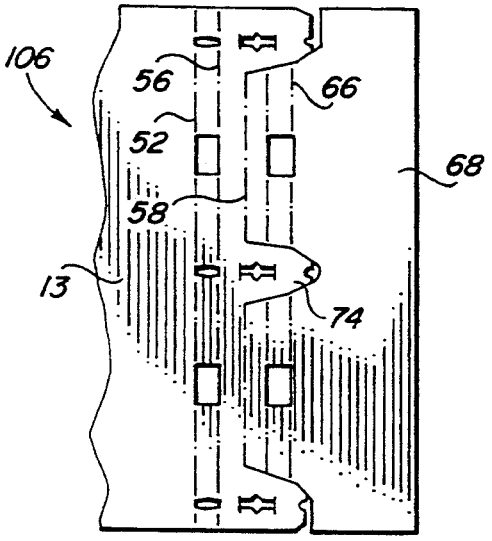
FIG. 7 is a partial plan view of a blank for forming a modified carrier.
Figure 8:
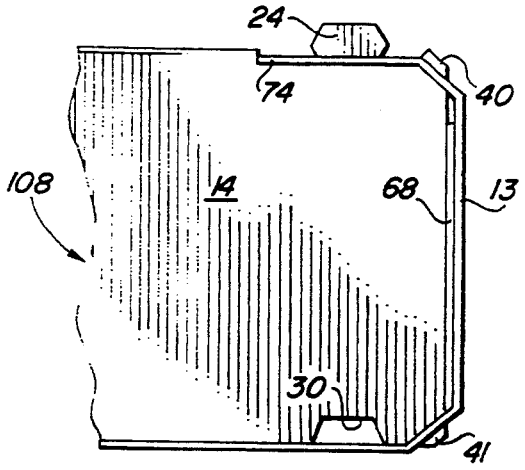
FIG. 8 is a partial enlarged end view of a carrier formed from the blank of FIG. 7.

One end of a modified blank 106 is illustrated in FIG. 7, wherein the blank is similar to the blank of FIG. 3 except that only one reinforcing panel section 68 is present, corresponding to the reinforcing panel section 68 of FIG. 3. In forming a container from the blank, the panel 68 is folded over and glued to the side panel 13, and the remainder of the container is formed as explained above. One end of the resulting container 108 is shown in FIG. 8, which shows that the side panel is of two-ply construction.

Figure 9:
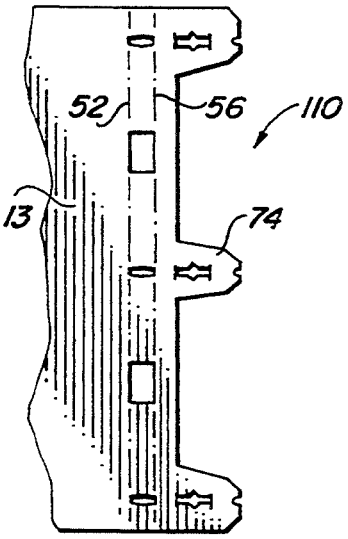
FIG. 9 is a partial plan view of a blank for forming another modified carrier.
Figure 10:
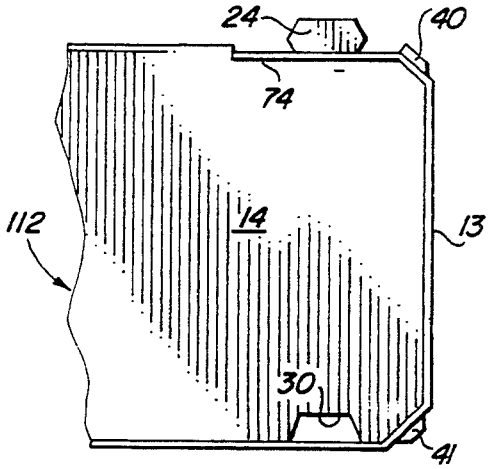
FIG. 10 is a partial enlarged end view of a carrier formed from the blank of FIG. 9.

Another modified blank 110 is illustrated in FIG. 9. This blank has no reinforcing panels and is formed into the container 112 of FIG. 10, which shows the side panel of the container to be of single-ply construction.

It will be clear to those skilled in the art that the die for cutting blanks for the three-ply container can also be employed to cut the blanks for the two-ply and single-ply containers by simply removing the unnecessary cutting blades. Thus, containers can be customized to meet the strength requirements of particular customers without requiring a number of different expensive cutting dies to be maintained in inventory. Helping to make this possible is the use of locking tabs instead of conventional top panel flaps to hold the ends of the flexible cover sheet in place. This is significant because it eliminates material which otherwise would have been required to form continuous top panel flaps, and which would result in even greater material requirements if two- or three-ply side panels were desired. Even though the top panel strip is quite narrow, the overall strength of the container is not diminished since the primary strength requirements of the container are met by the side panels and end panels. This also has the benefit of providing a larger, more open area at the top of the container through which the container can be loaded with produce or other items.

Figure 12:
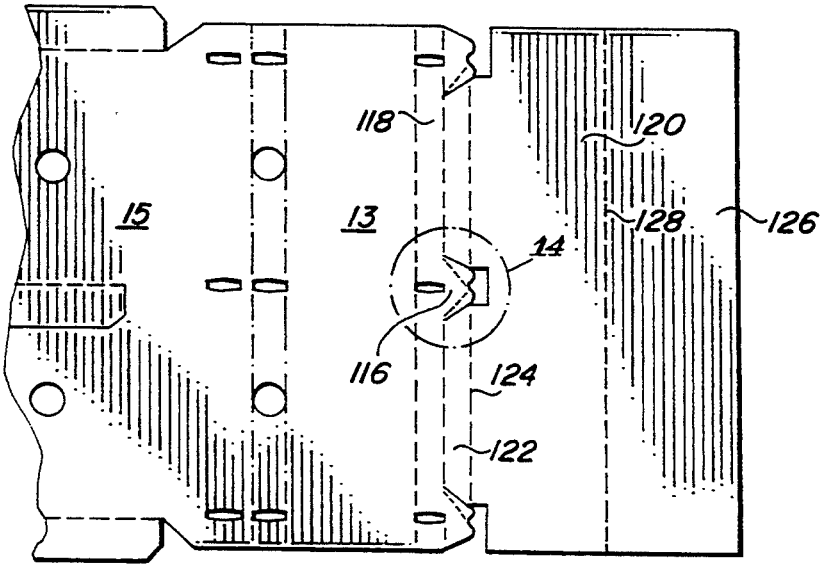
FIG. 12 is a partial plan view of the blank used in forming the cover sheet of the container of FIG, 11.
Figure 11:
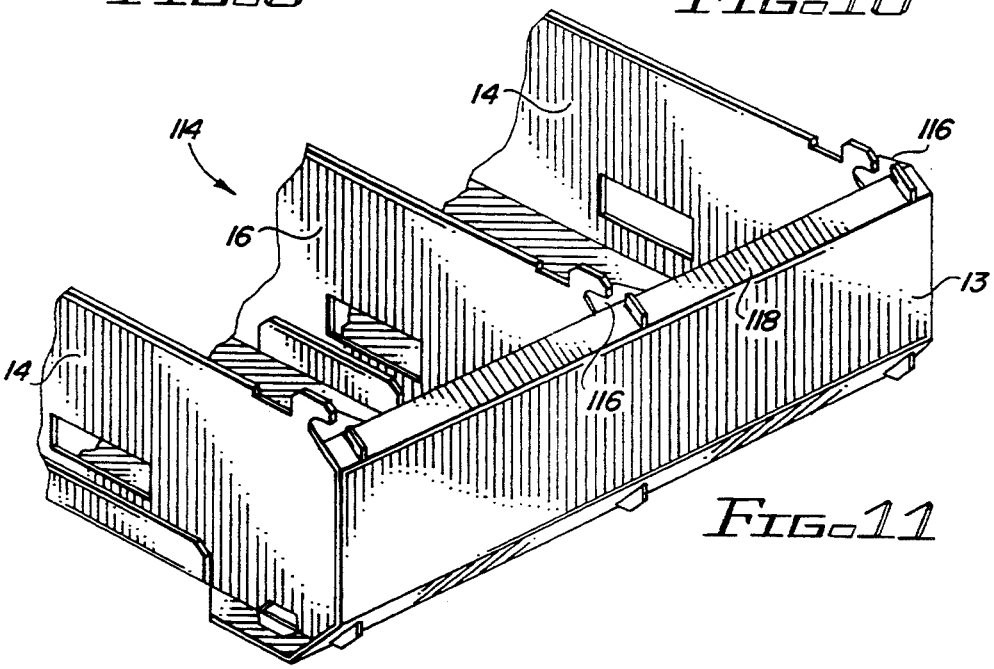
FIG. 11 is a partial pictorial view of a container which incorporates modified fastening tabs.
Figure 13:
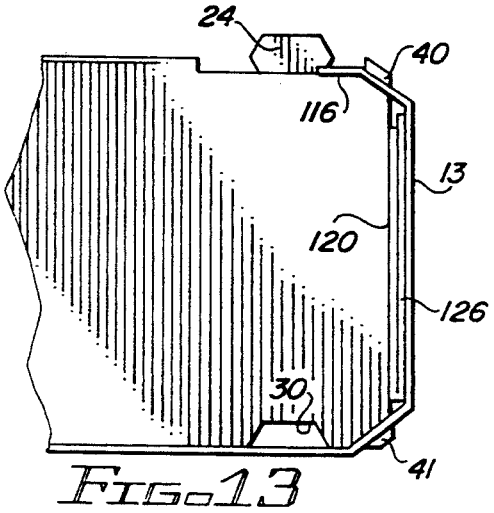
FIG. 13 is an enlarged partial end view of the container of FIG. 11.

Referring now to FIG. 11, a modified container 114 is shown which is basically similar to the container of FIG. 1 except that the top open area of the container has been made even larger. As in the first embodiment, the locking tabs 116 are connected directly to the upper bevel panel 118. In this case, however, there is no top panel strip extending between successive locking tabs. As shown in the blank illustrated in FIG. 12, the side panel structure is similar to that of the container of FIG. 1 in that a three-ply construction is provided. Thus a first side panel reinforcement section 120 is connected to bevel panel reinforcement section 122 by fold line 124 and a second side panel reinforcement section 126 is connected to the section 120 by fold line 128. The three-ply arrangement can be seen in the end view of FIG. 13. As shown in FIGS. 11 and 13, the end of the locking tab 116 is held in place at the outer edge of the stacking projection 24 of the end panel 14. Although a different locking arrangement is employed, as discussed in more detail below, the end panels and cross panel are identical to those of the first embodiment, making it necessary to have only one design of end panel in inventory.

Figure 14:
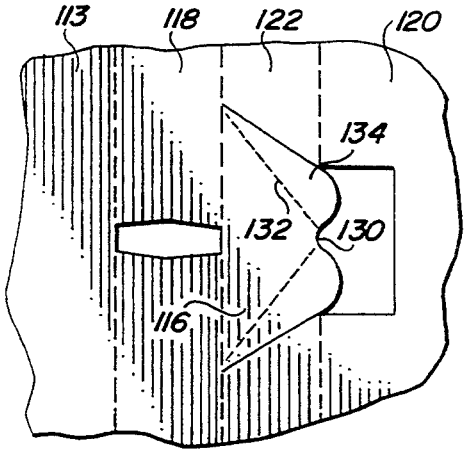
FIG. 14 is an enlarged plan view of the area of FIG. 12 within the circle 14, showing the modified fastening tab therein.

Referring to FIG. 14, the locking tab 116 has a notch 130 at its outer end and a fold line 132 extending from each side of the notch to the bevel panel 118 to form wings or flaps 134. The locking tabs are held in place by moving the notch 102 up against the base of the tapered edge 28 of the stacking projection 24. Because the tabs are relatively short compared to the locking tabs of the first embodiment, they offer the additional advantage of extending even less into the open space through which the container is loaded and require even less blank material. Being short, however, they are more difficult to flex down to bring the notch into engagement with the tapered edge 28. By folding the wings 134 down, however, the notched end of the locking tab can be moved down into position so that when the force moving the locking tab into position is removed, the edge 28 prevents upward movement of the locking tab. In both embodiments the upper bevel panels are held in place by the shoulders 40 of the end panels which extend through the slots 84 in the bevel panels. This relieves much of the stress which would otherwise be transferred to the locking tabs. As illustrated in FIG. 12, the end locking tabs contain only one inwardly facing wing. This is a preferred arrangement for the end locking tabs, as the absence of a fold line in the outer portion of the tab makes these critical tabs more rigid. It has been found that folding of the single wing in this case is enough to enable the tab to be positioned into place against the tapered edge of the stacking projection.

As indicated earlier, although the container of the invention has been shown for the purpose of illustration as including a single interior cross panel dividing the container into two bins, it may have no interior cross panel at all, in which case the container will present only a single bin, or it may have more than one interior cross panel to provide additional bins.

It can now be appreciated that the invention provides a container which enables it to be customized as to the number of plies making up the side panels, while not requiring extra cutting dies for each different type of container. The amount of paperboard required for the flexible cover sheet of the container is minimized by the design, yet the cover sheet is securely held in place by the locking tabs.

It should be obvious that although preferred embodiments of the invention have been described, changes to certain details of the embodiments can be made without departing from the spirit and scope of the invention defined in the appended claims.

What is claimed is:

1. A container, comprising:

two spaced, substantially parallel, relatively rigid end panels;

each end panel having two upper corner areas and an upwardly extending projection inwardly spaced a relatively short distance from each of the upper corner areas;

a flexible sheet forming bottom and side panels extending between the end panels;

each side panel including an upper inwardly sloped portion;

the upper corner areas of the end panels extending through slots in the upper sloped portions;

a locking tab extending from each upper sloped portion adjacent an end panel; and means for securing the locking tabs to associated end panel projections.

2. A container as defined in claim 1, wherein each of the end panels has a lower portion with recesses therein opposite the projections for receiving the projections of a similar adjacent stacked container.

3. A container as defined in claim 1, including at least one intermediate transverse panel similar to the end panels and being substantially parallel thereto, the upper sloped portions having additional locking tabs extending therefrom adjacent the intermediate transverse panel, and means for securing the additional locking tabs to projections on the intermediate transverse panel.

4. A container as defined in claim 1, wherein the side panels are of two-ply construction.

5. A container as defined in claim 4, wherein one of the plies is an exterior ply and the other ply is an interior reinforcing ply foldably connected to the upper sloped portion of each of the side panels.

6. A container as defined in claim 1, wherein the side panels are of three-ply construction.

7. A container as defined in claim 6, wherein one of the plies is an exterior ply, the second ply is an interior reinforcing ply foldably connected to the upper sloped portion of each of the side panels and the third ply is an interior reinforcing ply foldably connected to the second ply.

8. A container as defined in claim 1, wherein the locking tabs associated with each of the side panels are connected to each other by narrow strips foldably connected to the upper sloped portions of the side panels.

9. A container as defined in claim 8, wherein the side panels are of two-ply construction.

10. A container as defined in claim 9, wherein one of the plies is an exterior ply and the other ply is an interior reinforcing ply foldably connected to the narrow strip associated with each of the upper sloped side panel portions.

11. A container as defined in claim 8, wherein the side panels are of three-ply construction.

12. A container as defined in claim 11, wherein one of the plies is an exterior ply, the second ply is an interior reinforcing ply foldably connected to the narrow strip associated with each of the upper sloped side panel portions and the third ply is an interior reinforcing ply foldably connected to the second ply.

13. A container as defined in claim 1, wherein the means for securing the locking tabs to associated end panel projections comprises a slot in each locking tab, the end panel projections extending through the locking tab slots.

14. A container as defined in claim 13, wherein each projection is comprised of a relatively wide portion adjacent lower inwardly tapered edges and wherein the length of each slot is narrower than the relatively wide portion of the associated projection, the slot having ends defined by transverse slits which enable the slots to be moved over the relatively wide portions of the slots.

15. A container as defined in claim 13, wherein each locking tab has an end edge portion abutting an inwardly tapered edge of the associated end panel.

16. A container as defined in claim 15, wherein the end edge portion of each locking tab is the edge surface of a notch.

17. A container as defined in claim 1, wherein the means for securing the locking tabs to associated end panel projections comprises a lower inwardly tapered edge on each projection, each locking tab having an end edge portion abutting said edge.

18. A container as defined in claim 17, wherein the end edge portion of each locking tab abutting the lower inwardly tapered edge of the associated projection is the edge surface of a notch.

19. A container as defined in claim 17, wherein at least some of the locking tabs include fold lines forming oppositely located wing sections, downward folding of the wing sections allowing the edge portion of said locking tabs to be moved into place abutting the lower tapered edge of the associated projection.

20. A container as defined in claim 1, including glue flaps connected to the bottom panel, the glue flaps being adhered to the end panels.

* * * * *